US007322791B2

(12) United States Patent
Stilgenbauer

(10) Patent No.: US 7,322,791 B2
(45) Date of Patent: Jan. 29, 2008

(54) TURBINE UNIT AND VTG MECHANISM THEREFOR

(75) Inventor: Michael Stilgenbauer, Bolanden (DE)

(73) Assignee: BorgWarner, Inc., Auburn Hills, MI (US)

( * ) Notice: Subject to any disclaimer, the term of this patent is extended or adjusted under 35 U.S.C. 154(b) by 521 days.

(21) Appl. No.: 10/649,478

(22) Filed: Aug. 26, 2003

(65) Prior Publication Data

US 2007/0277525 A1 Dec. 6, 2007

(30) Foreign Application Priority Data

Aug. 26, 2002 (EP) ..... 02018295

(51) Int. Cl.

| | |
|---|---|
| ***F01D 17/16*** | (2006.01) |
| ***F01D 25/24*** | (2006.01) |
| ***F04D 29/44*** | (2006.01) |
| ***F04D 29/56*** | (2006.01) |
| ***F04D 1/10*** | (2006.01) |
| ***F02D 23/00*** | (2006.01) |

(52) U.S. Cl. ..... 415/164; 415/160; 415/163; 60/602

(58) Field of Classification Search ..... 60/602; 415/158, 160, 161, 162, 163, 164, 165; 417/407
See application file for complete search history.

(56) References Cited

U.S. PATENT DOCUMENTS

| | | | | |
|---|---|---|---|---|
| 2,860,827 | A * | 11/1958 | Egli | 415/164 |
| 4,643,640 | A * | 2/1987 | Burdette et al. | 415/164 |
| 4,654,941 | A * | 4/1987 | Burdette et al. | 415/164 |
| 4,679,984 | A * | 7/1987 | Swihart et al. | 415/163 |
| 4,773,821 | A * | 9/1988 | Gonthier et al. | 415/160 |
| 4,804,316 | A * | 2/1989 | Fleury | 417/407 |
| 4,867,636 | A * | 9/1989 | Sauron et al. | 415/160 |
| 5,964,574 | A * | 10/1999 | Meier et al. | 415/110 |
| 6,015,259 | A * | 1/2000 | Sishtla et al. | 415/166 |
| 6,287,091 | B1 * | 9/2001 | Svihla et al. | 417/407 |
| 6,546,728 | B2 * | 4/2003 | Schmidt et al. | 60/602 |
| 6,623,240 | B2 * | 9/2003 | Ertl et al. | 415/163 |
| 6,916,153 | B2 * | 7/2005 | Boening | 415/163 |
| 7,189,058 | B2 * | 3/2007 | Metz et al. | 415/165 |
| 2003/0170117 | A1 * | 9/2003 | Knauer et al. | 415/160 |
| 2005/0169748 | A1 * | 8/2005 | Metz et al. | 415/160 |

* cited by examiner

*Primary Examiner*—Thai-Ba Trieu
(74) *Attorney, Agent, or Firm*—Stephan A. Pendorf; Akerman Senterfitt

(57) ABSTRACT

A turbine unit having a rotor housing (2) having at least one admission channel (9) for a fluid, as well as a turbine rotor (4) which is supported in a turbine space (23) of the rotor housing (2) and wherein fluid is led into the turbine space (23) at its periphery through a VTG mechanism (5-8) of variable turbine geometry. The VTG mechanism (5-8) has a nozzle ring (6) having a plurality of vane shafts (8) which are arranged in the form of a crown on the nozzle ring (6) and which carry on one of their ends vanes (7) which can be moved from a substantially tangential position (relative to the crown) into a substantially radial position, as well as at least one control element (19) in order to pivot the orientation of the vanes (7).

11 Claims, 5 Drawing Sheets

TURBINE UNIT AND VTG MECHANISM THEREFOR

CROSS REFERENCE TO RELATED APPLICATION

This application is based upon European Patent Application No. 02 018 295.2, filed Aug. 26, 2002, from which priority is claimed.

TECHNICAL FIELD

The present invention relates to a turbine unit—in particular, a turbocharger, as well as for other types of fluid flow machines, such as secondary air pumps—comprising a turbine rotor housing having at least one admission channel for a fluid—in the case of an employment of the invention for a turbocharger this will be the exhaust gas of a combustion engine—and a turbine rotor, which is housed in a turbine space of the rotor housing and said fluid is led to the periphery of the turbine rotor through a variable geometry mechanism. The variable geometry mechanism comprises a nozzle ring having a plurality of nozzle shafts which are arranged in the nozzle ring in the form of a crown, and wherein each shaft has nozzle vanes fixed to one of its ends, said nozzle vanes being capable of being adjusted from a substantially tangential position into an approximately radial position (as seen with reference to the crown of vane shafts) as well as at least one adjusting element for adjustment of the position of the vanes. Moreover an actuation mechanism is provided in order to convey regulated movements to the variable geometry mechanism by means of a control ring, which is provided coaxially to the nozzle ring and adjacent thereto, and which is connected with at least one control element, as well as a guiding and centering mechanism for the control ring, having at least one roller bearing which comprises cylinders which roll on a contact surface of the control ring.

BACKGROUND OF THE INVENTION

A turbine unit of this type has been disclosed in U.S. Pat. No. 4,179,247. This document emphasizes correctly without doubt, that high precision of guiding and centering can be obtained with a roller bearing, it being understood that the document discloses a ball bearing. Although this document is older than twenty years already, it has had no impact on any practical application. The reason is probably that the turbine housing—in order to house the roller bearing—has such a complicated shape that it could not be reasonably fabricated. In addition the necessary surface treatments on portions which are not easily accessible, would have additionally increased fabrication cost. The measures which are taken in order to allow access to parts which possibly need repair, weaken the housing, and result in an unacceptable lack of operational security. This disclosure—in spite of the likely advantages of a roller bearing—was not sufficiently matured and therefore not suitable for practical application.

It was already known to locate the control elements on the vane shafts at their ends opposite to the nozzle ring, and whereby control levers were used with each extending approximately radially and which comprised one free end. It is additionally known from DE-C-954,551, to provide the control ring with teeth in which a pinion may engage. Other control mechanisms have been proposed which use the effect of interengaging teeth. Also the use of cams in form of slots is known in order to pivot the vanes around their shafts.

SUMMARY OF INVENTION

The invention has the objective to create a simple and easy to assemble construction of a VTG mechanism while using (at least) one roller bearing that maintains said advantages.

According to the invention this objective is obtained in a VTG mechanism wherein the roller bearing is arranged between the control ring and a fastening ring which is releasably connected with the rotor housing, so that the control ring, roller bearing and the releasably connected ring may be mounted into the rotor housing as one modular unit.

In this way not only is the mounting facilitated, but the rotor housing can also be simplified and thereby will be more stable. The precision which is inherent to a roller bearing is also maintained therewith. In addition this permits the prefabrication of the unit along with the vanes and spacers etc. so that the unit may constitute a proper commerciable object.

In the same way as in U.S. Pat. No. 4,179,247, the roller bearing may also be a ball bearing, such as will be apparent from the following description. It is, however, preferred that the roller bearing is a cylinder bearing.

In order to create a cage, i.e. a means for holding together the rollers of a roller bearing, it is of advantage, that the roller bearing is housed in an axially open free space of one of the rings, preferably of the control ring, and this free space is closed by another ring, which can house axial extensions of the rollers of the roller bearing. In this way the friction of the rollers among each other and their number may be decreased if the rollers can be held a certain distance from one another by said holding ring. The roller bearing may therefore comprise cylinders or balls, which are either present in a sufficient number in order to substantially fill the free space, or it can have a limited number of at least three cylinders or balls which are guided by a holding ring in said free space.

Cost and the necessary space for the mounting of the modular unit may further be decreased if the function of the releasably connected ring is assumed by the nozzle ring itself.

A problem in turbochargers is the enormous heat which results in important thermal dilatations. An approach has been made already in different guiding mechanisms, to design them in a way that the rotational bodies may run either on an exterior or an interior track (see U.S. Pat. No. 4,659,295). The present invention, however, is based on the finding that the control ring and the nozzle ring may have been pre-centered previously by means of the control levers which extend between them. Therefore, it is preferred in this invention that the plurality of control elements is arranged on the side of the nozzle ring opposite the vanes and which are constituted by adjustment levers which are fastened to free ends of the vane shafts and extending radially, having one free end each. The guiding and centering mechanisms then only need to secure their coaxial position. Of course a like pre-centering will be obtained also if each control element is formed by a pinion which engages into a toothed crown.

Under these circumstances it is not absolutely necessary that the roller bodies are in constant abutment with at least one rolling track, it can be more advantageous if the diameters of the control ring and of the releasably connected ring which cooperate with the roller bearing, are dimensioned such as to substantially produce a radial play of the roller bodies. This play will then correspond to the admitted tolerances. "Substantially" means that in the region of the upper respectively lower threshold temperature or within the tolerances, this play may be 0 and the roller bodies will then abut on the one or the other ring. The design according to the invention not only secures a problem-free control movement within all temperature regions, but moreover increases the lifetime of the roller bearing.

Without any doubt it is possible in the framework of the present invention, to fasten the modular unit within the housing by means of screws. It is, however, preferred when the modular unit, comprised of the control ring, the roller bearing and the releasably connected ring (the unit will generally also include additional elements such as spacers and fastening elements), is maintained in non-rotatable condition through inter-engaging projections and depressions, and preferably is solicited into this position through a soliciting device. This will make assembly much simpler. Alternatively one could provide a snap connection between the projections and depressions instead of a soliciting device.

Of course roller bearings are vulnerable to soiling and it is therefore advantageous to provide a ring shaped sealing between the turbine space and the roller bearing.

In the framework of the present invention it would be possible to provide the roller bodies between an external surface of the control ring and the internal surface of a ring surrounding the latter and being releasably connectable with the housing. This, however, increases the radial space requirement, and it is therefore preferred that the rolling contact surface of the releasably connected ring have a smaller diameter than the rolling contact surface of the control ring.

The present invention also relates to a VTG mechanism of turbine units as discussed hereinabove, which comprises the above discussed features.

BRIEF DESCRIPTION OF THE DRAWINGS

Further details of the invention will be apparent on the basis of the following description of embodiments, illustrated in the schematic drawings.

DETAILED DESCRIPTION OF THE INVENTION

Figure 1:
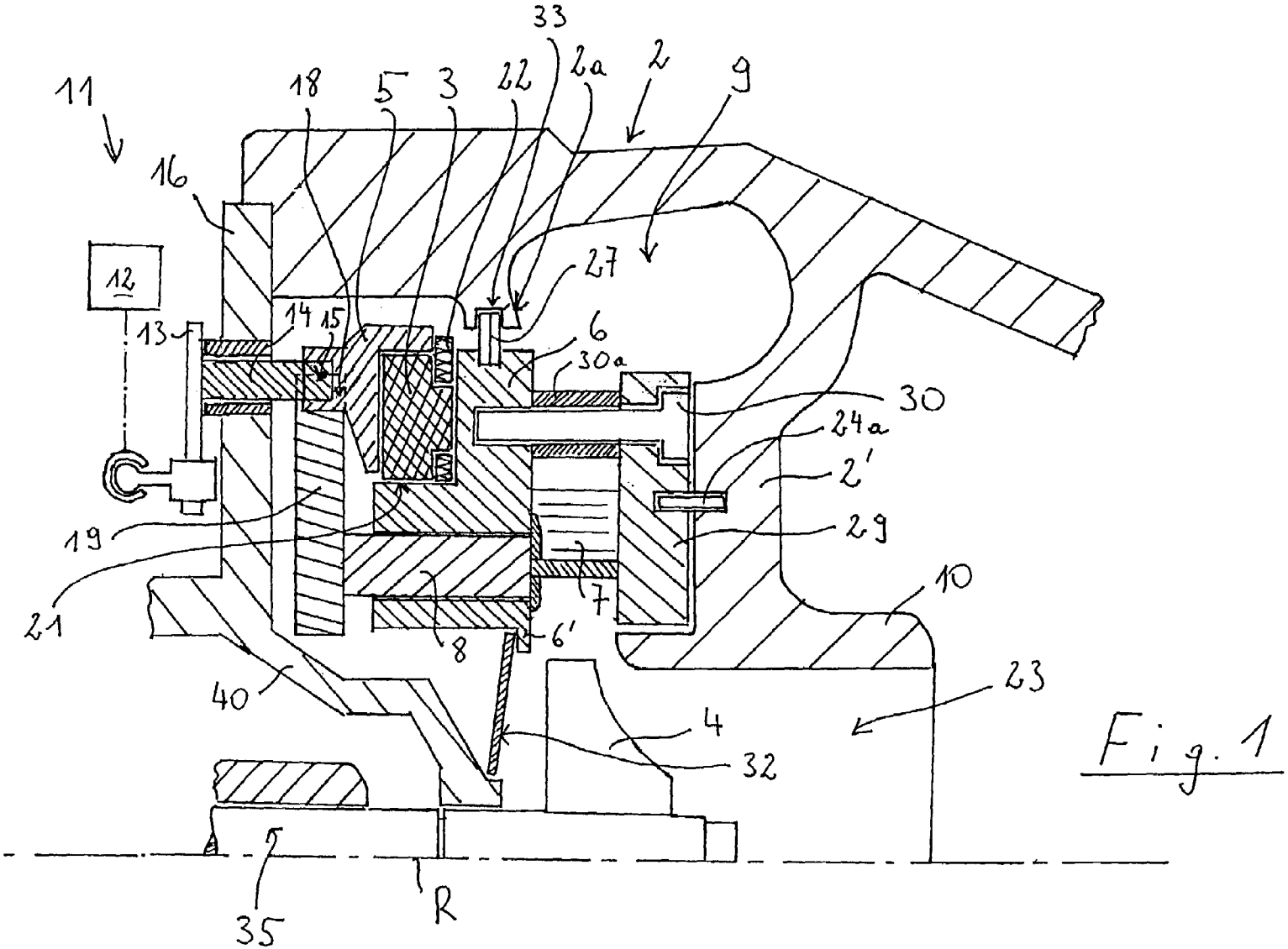
FIG. 1 shows a half axial cut through a rotor housing, in which a VTG mechanism according to the present invention, is mounted.

According to FIG. 1 a turbine housing 2 is connected with a flange 16 of the bearing housing, from which a cylindrical member 40 extends into the turbine housing 2 and carries shaft 35 of a turbine rotor 4. The turbine housing 2 comprises an admission channel 9 which surrounds a turbine rotor 4, guiding a fluid which drives turbine rotor 4 (in the case of a turbocharger this fluid is an exhaust gas of a combustion engine), a rotor space 23 and an axial cylinder 10 through which the fluid, respectively the exhaust gas, will be discharged.

In order to lead fluid to turbine rotor 4 in regulated or controlled manner, a device is provided at the exit of an admission channel 9 before rotor space 23, which is known in the art as VTG (variable turbine geometry) mechanism. This VTG mechanism comprises in principle a crown of movable vanes 7 concentrically surrounding turbine rotor 4 (see FIG. 4), which are carried by control shafts 8 which are firmly connected thereto, and which are located in a nozzle ring 6 which coaxially surrounds turbine rotor 4.

The rotation of the control shafts 8 may be effectuated in known manner as shown e.g. in U.S. Pat. No. 4,659,295, which shows an actuation device that comprises a control box 12, that controls the control movement of a pusher which is indicated in dash-dotted line, whose movement is transformed, through an actuation lever 13, an actuation shaft 14 which is connected therewith, and an eccentric 15 which engages into a hole of control ring 5 that is located next to the nozzle ring 6, into a small rotational movement of ring 5 around axis (R). The free ends or heads 18 of the control levers 19 are located in excavations 17 (see FIG. 4) of control ring 5, whereby the other ends of the control levers are fastened on the control shaft 8. Instead of excavations 17 which go all the way through in radial direction, one can also provide, in known manner, grooves on the radial inner side of the control ring 5 in which heads 18 are located, so that said heads 18 assure a certain pre-centering. As one will see from the following description, in the solution according to the invention, it is not necessary that this be the case, so that control ring 5 may have, other than in the state of the art, an even smaller diameter.

Through the said rotational movement, vanes 7 may be reoriented by shafts 8 relative to the turbine rotor such that they may rotate from an approximately tangential extreme position into an approximately radially extending opposite extreme position. Consequently more or less exhaust gas is led through the admission channel of a combustion engine on the turbine rotor 4 whereafter it is discharged along rotational axis R through axial cylindrical portion 10.

This mechanism as described hereinabove is principally known. However, in the state of the art, means were used for the guiding and the centering of control ring 5 relatively to nozzle ring 6, which were fastened to the housing 2, which are difficult to mount and which nevertheless permitted only relatively small precision. As mentioned above there has been made already an approach to use roller bearings, but it was not feasible in practice because the roller bearing was to be mounted onto surfaces which needed precise treatment, whereas the rotor housing was subjected additionally to largely variable temperatures. In order to nevertheless obtain high precision with minimum constructional effort and minimum mounting effort, the roller bearing with its rollers 3 in the shape of cylindrical rollers, is located between control ring 5 and a bearing ring which is releasably connected to the rotor housing. The separation already of the releasable connected ring, serving as rolling contact surface, from the proper rotor housing protects said ring from an immediate heat transfer from housing 2 to itself. Additionally it is possible to mount control ring, roller bearing and releasably connected ring (together with the above mentioned additional elements) as a modular unit into the rotor housing, i.e. it enables premounting, which may of course be carried out much easier and automized.

Figure 2:
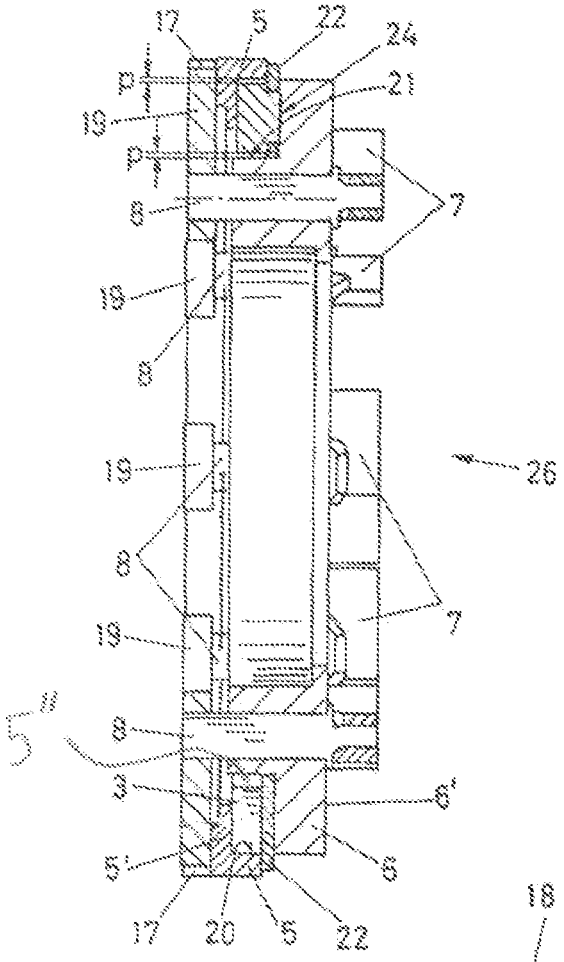
FIG. 2 is a cut representation of a VTG mechanism according to FIG. 1.

As can be seen from FIGS. 1 and 2, control ring 5 comprises a rolling contact surface 20 which is oriented inwardly, and on which rollers 3 may roll. This is, however, only preferred in terms of tolerance compensation, because in practice it is preferred when rollers 3 maintain a certain radial play p (FIG. 2) in all operational phases between themselves and rolling contact surface 20 as well as between themselves and an opposing external contact surface 21, which forms a shoulder on nozzle ring 6.

Figure 4:
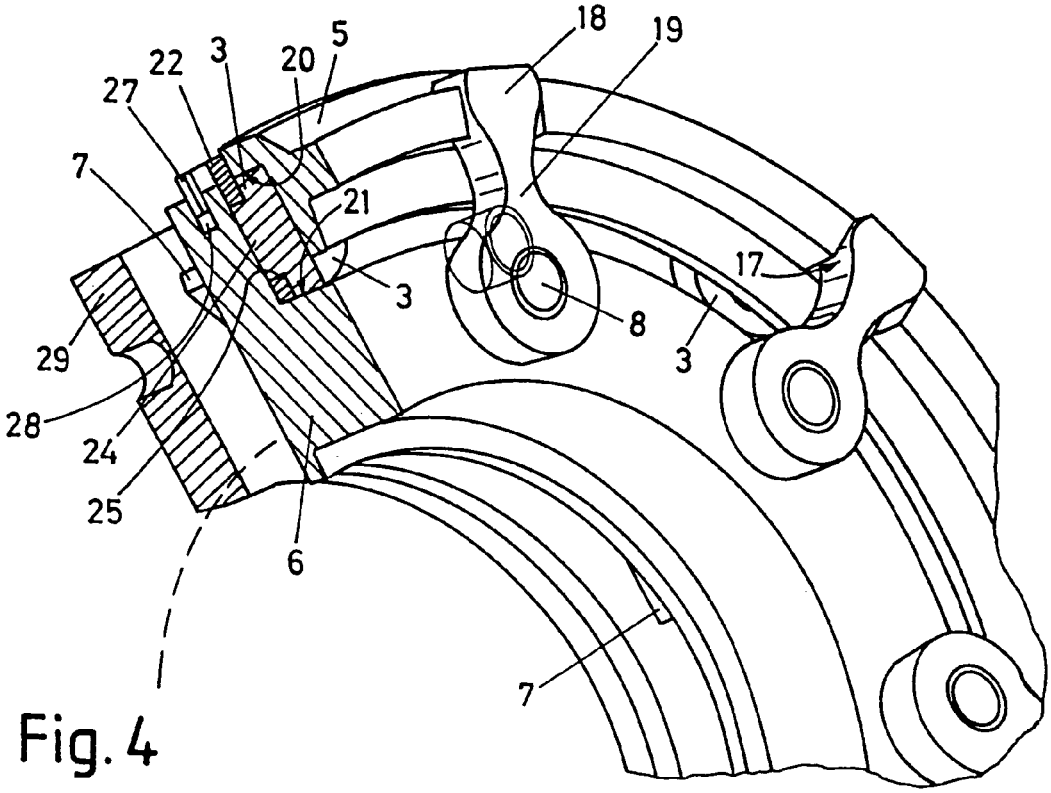
FIG. 4 is a cut perspective view from the side of the control ring.
Figure 6:
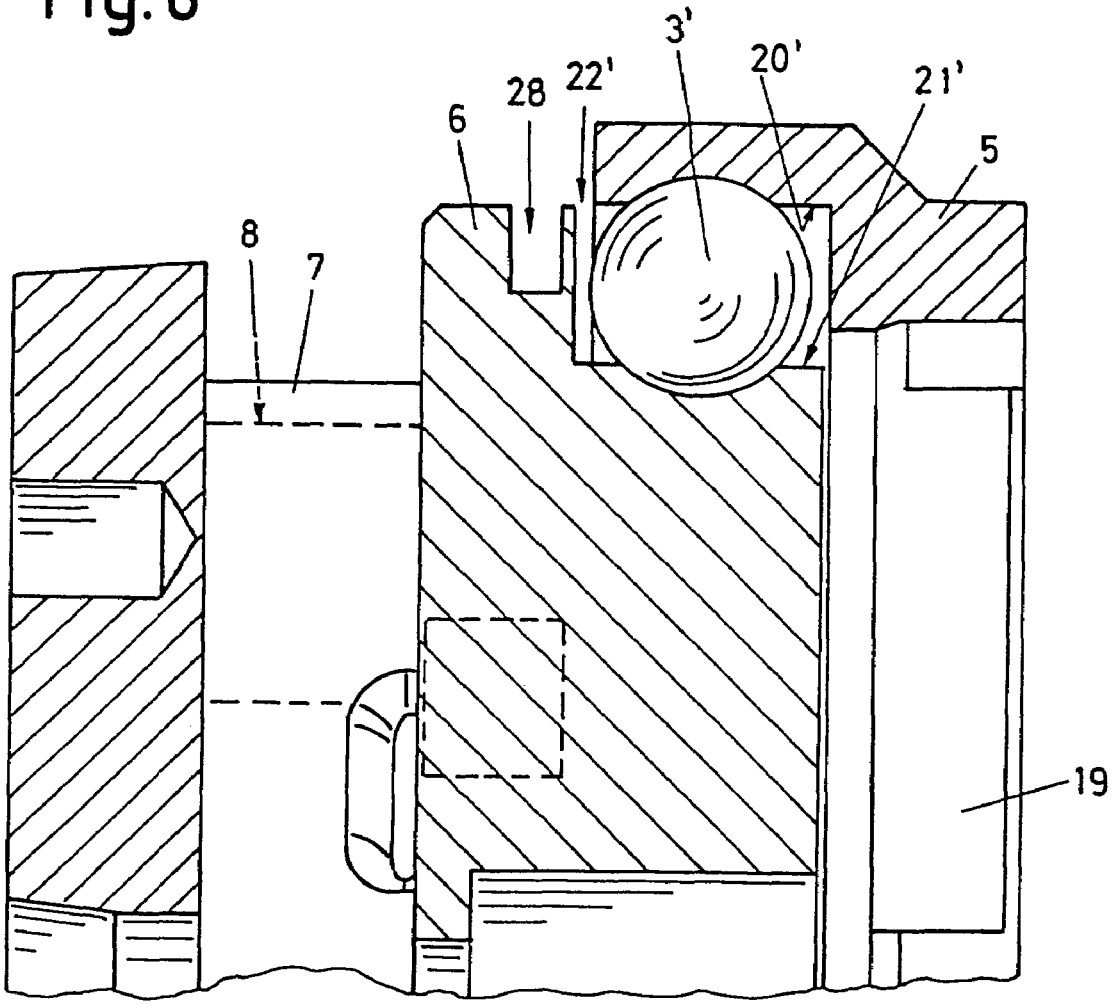
FIG. 6 is a cut through the upper side of a fourth embodiment.

As it has been explained already with respect to FIG. 4, only a small number of rollers 3 are required, if a cage for holding ring 22 is provided. Rollers 3 may run within holes of appropriate size, corresponding to the rollers, in the holding ring 22, rollers 3 may advantageously comprise axial extension 24 of smaller diameter, which engage into holes 25 in the holding ring 22, so that the latter provides the necessary distance between rollers 3 in peripheral direction as well as it holds them firmly on and against rolling contact surfaces 20 and/or 21. Referring to FIG. 6 further down, it will be explained that a like holding ring, more in the sense of a cage ring, may be used also for roller bearings with balls as roller bodies, which rollers 3 are held by this ring in certain distances from each other along the periphery of the rolling contact surfaces, whereby the cage ring comprises depressions which correspond to the balls. For rollers 3' (FIG. 6) this distance is less critical, because even if they are tightly arranged one next to the other, they will only have temporary contact between them, whereas with tightly packed rollers 3, linear contacts are produced, which would result in increased friction. Therefore the holding ring 22 is of special advantage for the use of rollers as rolling bodies, especially as under the high rotational speeds of turbochargers, this friction can play a non-negligible role.

As shown in FIG. 1, it is possible, to provide the modular unit or cartridge which is comprised of control ring 5, nozzle ring 6 and all the other, therewith connected elements, additionally with a fastening ring 29, which may either be screwed onto a wall 2' of turbine housing 2 or as shown, can be screwed by means of bolts 30 and with the use of spacers 30*a* to nozzle ring 6.

It may also have a soliciting device such as a plate spring 32, which abuts on an inner flange 6' of nozzle ring 6 in order to immobilize it in axial direction and to press it against wall 2'. The other radial end of plate spring 32 abuts on a cylinder portion 40 of the bearing housing. In this case it is useful to bear the fastening ring by means of pins 24*a* in the turbine housing in non-rotational, but axially movable manner.

If a plate spring 32 is used as the soliciting device in order to obtain a firm positioning of unit 26 (see FIG. 2) in housing 2, one has to be aware that if one wants to use the preferred design for a turbocharger as described hereinabove, that such a plate spring 32 will be subjected to enormous thermal stress, which could reach from freezing temperature in winter during shut down of the engine up to almost 1000° C. This will of course have a certain impact on the metallic structure of the plate spring 32, another reason why other soliciting devices or soliciting means may generally be preferred. Thus, it is possible to provide gas springs around the periphery of modular unit 26, i.e. pistons which slide within cylinders which, when filled with air and which have a return valve, whereby the piston rods are pressed against nozzle ring 6. The air could be taken from the compressor space (of the non-illustrated compressor which is arranged on rotation axis R). Although a pressure charging device is preferred, a device which creates a drawing force is also imaginable.

Figure 1A:
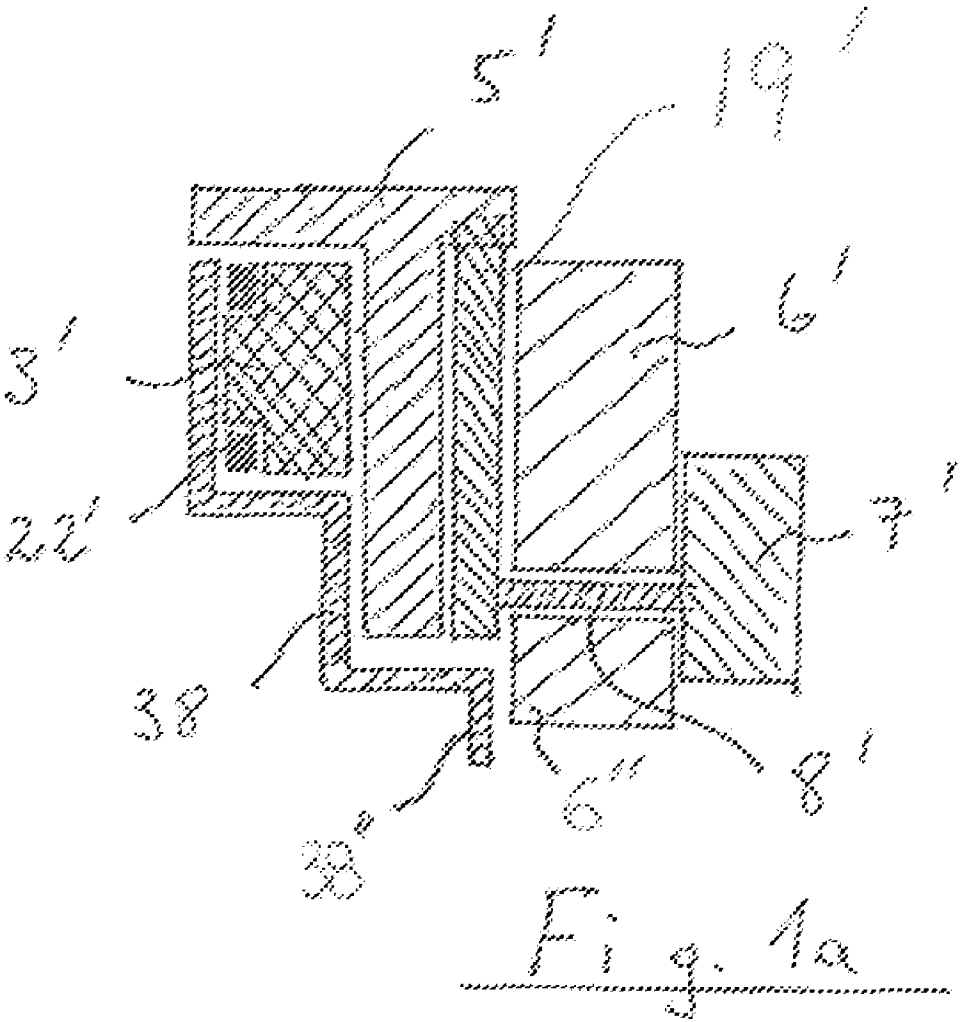
FIG. 1*a* is an alternative embodiment for a VTG mechanism which may also be preassembled.

In FIG. 1*a* an alternative solution is illustrated for the VTG mechanism which can be pre-assembled in cartridge form. Here the rollers 3' are not supported between control ring 5' and nozzle ring 6', but between control ring 5 and a further ring 38, which is releasably connectable with a portion of the housing, and said rollers 3' are arranged on the side of the control ring 5" which is opposite to the nozzle ring 6'. The fixation of the cartridge may be carried out through a solidarization of ring 38 with nozzle ring 6' (not illustrated) such as through screwing or welding from radially inner of portions 6" and 38" of these two rings 6' and 38 which practically abut on one another. FIG. 1*a* further shows a vane orientation mechanism 8', 19' as well as a cage ring 22', which houses parts of rollers 3'.

Figure 5:
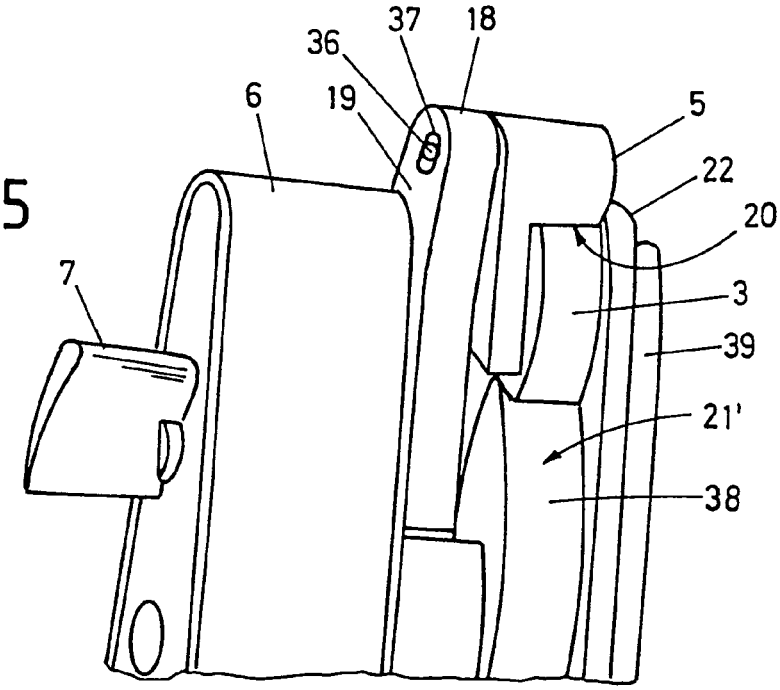
FIG. 5 is a perspective partial view of a further embodiment.

The embodiment illustrated in FIG. 5 uses this alternative solution.

The modular unit 26 of FIG. 1, as illustrated in FIG. 2, comprises the holding ring 22, located preferably between a inner flange 6' of the nozzle ring 6 and a radial flange 5' of control ring 5 which extends inwardly, and which thus delimits an axial open free space 5", in which rollers 3 are located. It is understandable that the cooperation of control ring 5 and of nozzle ring 6 (which is the further ring in the present embodiment) may also be designed reversely, inasmuch as control ring 5 may possess a inner flange 6' and nozzle ring 6 may have an axially open free space 5". Actually its contact surface 21 forms, together with inner flange 6' such an axially open free space 21. FIG. 2 further illustrates that control shafts 8 may have a decreased diameter at their ends corresponding to vanes 7, which may be press fitted into borings of vanes 7.

Figure 3:
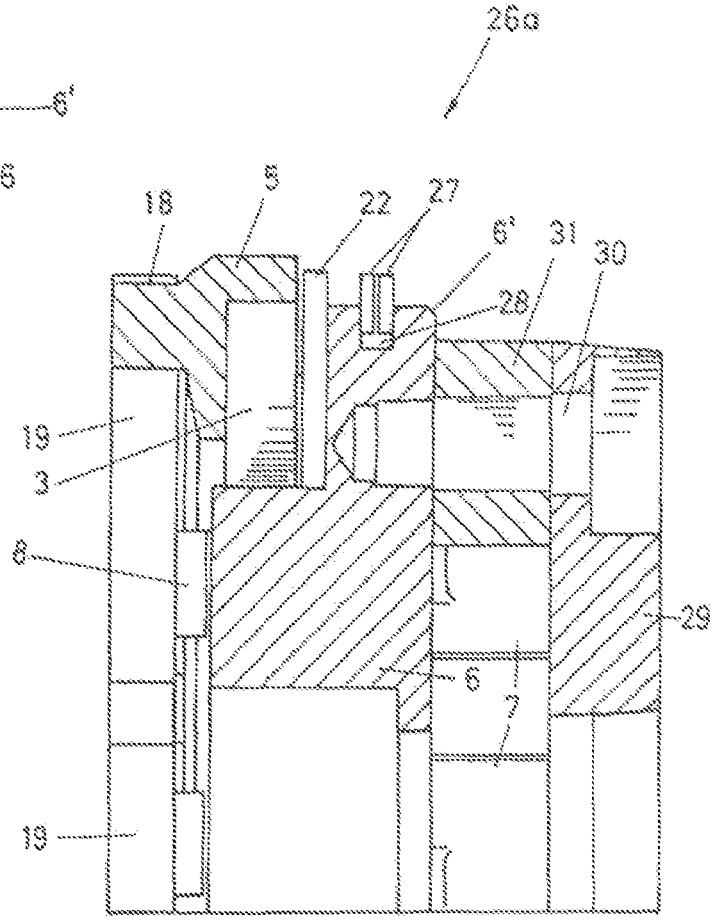
FIG. 3 is a variation of the embodiment according to FIG. 2 including a sealing, whereby only the upper portion of FIG. 2 is illustrated in enlarged scale.

FIG. 3 illustrates a slightly modified unit 26*a* in a similar cut as in FIG. 2. The modification with respect to FIG. 2 concerns the use of a seal ring 27 within a seal groove 28 of nozzle ring 6. As shown from a comparison with FIG. 1, nozzle ring 6 is located in the region of housing wall 2*a*. One could think of different types of sealing arrangements: either sealing ring 27 is designed as a flexible sealing lip, which fits from below against wall 2*a*. This is in principle problem free, because these two parts do not move relatively to each other during operation. It is, however, also possible (or additionally employable) that sealing ring 27 may reach into a groove of wall 2*a* and thus forms a kind of labyrinth sealing, as well as combinations of both possibilities can be used. With the use of this type of sealing, one may inhibit soiling of roller bearing 3, 20, 21 coming from the area of the admission channel.

A further modification of unit 26*a* with respect to unit 26 is that it comprises a fastening ring 29 which protects vanes 7 in a defined distance (see FIG. 1), which ring 29 may be fastened to wall 2. It may however also be fastened to the nozzle ring 6 by means of bolts 30, whereby, in known manner, spacers 31 provide a slightly larger distance as the width of the vanes 7, in order to provide free movement of vanes 7 in all temperature ranges.

Although, as already discussed hereinabove, with reference to FIG. 4, the two compared units 26 and 26*a* are not different as to the design of the roller bearings, it will now become clear in comparison with FIG. 3, that FIG. 4 is illustrating a different embodiment than FIG. 3, since it shows holding ring 29 as well as sealing ring 27.

The embodiment according to FIG. 5, however, is different from the hereto described variations inasmuch, as the chain of parts in axial direction has been reversed. Although this possibility is discussed here only with reference to one single example, it should be clear that combinations of the above described modifications and variations are within the spirit of the present invention.

According to the embodiment of FIG. 5, control levers 19 are not positioned on the side of control ring 5 which is opposite to nozzle ring 6, such as illustrated, but between those two rings 5, 6. Control ring 5 may be designed such as illustrated in FIG. 4, it may however also comprise pins 36 which reach into long holes 37. While control ring 5 again comprises a rolling contact surface 20 for rollers 3 which is radially inwardly oriented, the other, opposite rolling contact surface 21' is formed by a long hole 37, which is housed within control ring 5 and its running contact surface 20. In axial direction then follows again holding ring 22. In order to immobilize movable holding ring 22 in axial direction an end ring 39 may be present which would be firmly connected to ring 38, such as for example through screws and spacers which are arranged around said screws, and which extend through holding ring 22. Substantially this end ring plays a similar role as the fastening ring of FIGS. 3 and 4 on the other side, inasmuch as it assures the holding together of the modular unit, and it may be connected with the housing 2 in one of the described fashions.

Hereinabove reference has been made already to FIG. 6. It needs to be said, however, that the arrangement in FIG. 6 is similar as in the case of the embodiments according to FIG. 1 to 4. This means that rollers 3', 20', 21' between control ring 5 and nozzle ring 6, is preferred. However it has to be emphasized again, that also in this case an arrangement according to FIG. 5 could be chosen in which the rolling bodies roll on a separate roller ring 37. It is also visible, that here rollers 20', 21' comprise depressions to receive rollers 3', so that a specific cage ring (according to holding ring 22) is not necessary, although there may be space for it. If one wishes instead of the rollers 20', 21' to use cylindrical surfaces, it would certainly be necessary to use rollers 3 (see the previous examples) or one could use a cage ring according to the above discussed embodiment within a slot 22'. Further one can see in FIG. 6 that a sealing groove 286 is provided in which can be inserted either a sealing ring 27 (FIG. 3, 4) or a sealing ring which is located in the housing, and which can be formed as a piston ring in order to form a labyrinth sealing.

As already mentioned, it is within the framework of the present invention that all characteristics which have been described with reference to a particular embodiment can be combined with themselves as well as with characteristics known from the state of the art. It has been mentioned that the embodiment according to the invention may preferably be employed for turbochargers, as it has been optimally conceived for operation parameters of such turbochargers. It is, however, also imaginable to employ the invention for operation with other types of fluids. Further it is understandable that the rotor housing may comprise several turbine rotors 4 and/or several admission channels 9 such as it has already been proposed in the state of the art. In the case of several rotors 4 one can provide several VTG mechanisms 26, 26*a*, which may be the same or different, so that for instance one VTG mechanism corresponds to one of the described embodiments and another one to another embodiment.

| List of reference numbers | |
|---|---|
| 2 | rotor housing |
| 2a | wall of 2 |
| 2' | wall of 2 |
| 3 | roller body (rollers) |
| 3' | balls |
| 4 | turbine rotor |
| 5 | control ring with radial flange 5' |

-continued

| List of reference numbers | |
|---|---|
| 6 | nozzle ring with flange 6' |
| 7 | vane |
| 8 | control shaft |
| 9 | admission chanel |
| 10 | axial rod |
| 11 | actuation device |
| 12 | control box |
| 13 | actuation lever |
| 14 | actuation shaft |
| 15 | excentric |
| 16 | flange |
| 17 | excavation |
| 18 | head respectively end of lever of 19 |
| 19 | control lever |
| 20 | rolling contact surface of 5 |
| 21 | roller contact surface of 6 |
| 21' | roller contact surface of 6 |
| 22 | cage or holding ring (in 22') |
| 23 | rotor space |
| 24 | axial extension |
| 25 | holes of 22 |
| 26 | modular unit |
| 27 | sealing ring |
| 28 | sealing groove |
| 29 | fastening ring |
| 30 | bolt |
| 31 | spacer |
| 32 | plate spring |
| 33 | teeth |
| 35 | rotor shaft |
| 36 | pin |
| 37 | long hole |
| 38 | roller ring |
| 39 | endring |
| 40 | cylinder portion |

The invention claimed is:

1. A turbine unit for a turbocharger comprising: a rotor housing (2) with at least one admission channel (9) for a fluid;

a turbine rotor (4) which is supported in a rotor space (23) of the rotor housing (2);

a nozzle ring (6) with a plurality of shafts (8) located on said nozzle ring (6) in a crown formation, and which comprises on one side vanes (7), which are susceptible to being turned from a substantially tangential position into a substantially radial position with respect to said crown, and at least one control lever (19) in order to change the position of the vanes (7);

an actuation device (11) in order to create control movements which are transmitted to a VTG mechanism (5-8) with variable geometry;

whereby transmission of the control movements is effectuated by a control ring (5) positioned coaxially with said nozzle ring (6) and adjacent thereto, and which is movably connected with said at least one control lever (19), as well as a guiding and centering device for the control ring (5), which comprises at least one roller (3, 20, 21) which substantially rolls on a roller contact surface (20) of the control ring (5);

wherein said rollers (3, 20, 21) are arranged between the control ring (5) and a releasably connectable ring (6, 38), wherein said releasably connectable ring is releasably connected with the rotor housing (2), and wherein said rollers (3), said control ring (5), said nozzle ring (6), said vanes (7), and a vane orientation mechanism (8, 19) are assembled as a modular unit (26) being inserted into said housing (2) as one piece.

2. The turbine unit according to claim 1, comprising at least one of the following:

a) the rollers (3, 20, 21) are cylinder bearings;

b) the releasably connectable ring is the nozzle ring (6);

c) the modular unit (26*a*) further comprises a fastening ring (29) which is positioned opposite to the vanes (7) on the rotor housing (2) and fastened therewith, and is connected with the nozzle ring (6).

3. The turbine unit according to claim 1, wherein the rollers (3, 20, 21) are housed in an axially open free space (5"), and wherein the free space (5") is closed by a holding ring (22), wherein said holding ring (22) comprises axial extensions (24) of the rollers (3), wherein the rollers (3) are held by the holding ring (22) at a certain distance from one another.

4. The turbine unit according to claim 1, wherein a plurality of control levers (19) are fastened on the shafts (8) on a side of the nozzle ring (6) that is opposite to the vanes (7), wherein said plurality of control levers (19) extend approximately radially, and wherein each of the plurality of control levers (19) has a free end (18).

5. The turbine unit according to claim 1, wherein a diameter of the control ring (5) and a diameter of the releasably connectable ring (6) which cooperate with the rollers (3, 20, 21) are of a dimension to allow a certain radial play P of the rollers (3) at all operation temperatures.

6. The turbine unit according to claim 1, wherein the modular unit (26, 26*a*), the control ring (5), the rollers (3, 20, 21) and the releasably connectable ring (6) are held together in non-rotatable fashion through inter-engaging projections and depressions (33).

7. The turbine unit according to claim 1, wherein at least one seal groove (28) is arranged between the rollers (3, 20, 21) and an admission channel (9).

8. The turbine unit according to claim 1, wherein a roller contact surface (21) of the releasably connectable ring (6, 38) has a smaller diameter than the roller contact surface (20) of the control ring (5).

9. The turbine unit according to claim 8, further comprising at least one of:

the rollers (3, 20, 21) are at least one of a cylindrical bearing or a ball bearing; the rollers are housed in an axially free space (5") of the control ring (5) whereby said free space (5") is closed by a holding ring (22) which has axial extensions (24) of the rollers (3); the releasably connectable ring is the nozzle ring (6*a*); the diameters of the control ring (5) and of the releasably connectable ring (6, 38) which cooperate with the rollers (3, 20, 21) are calculated to provide a radial play (P) of the rollers at all operating temperatures; the modular unit (26, 26*a*) is held in a non-rotatable state through inter-engaging projections and depressions (33), and is solicited into this position by a soliciting device (32); between the rollers (3, 20, 21) and a space (9, 23) which carries fluid, a ring shaped sealing (27, 28) is provided; the rollers are formed in a free space (5") by a number of cylinders or balls which fill said free space (5"); or the rollers are formed by at least three cylinders or balls that are guided in the free space (5") by a freely rotatable holding ring (22).

10. The turbine unit according to claim 1, wherein the modular unit (26, 26*a*), the control ring (5), the roller bearing (3, 20, 21) and the releasably connectable ring (6) are held together in non-rotatable fashion through inter-engaging projections and depressions (33), and wherein the modular unit is solicited into this position by means of a soliciting device.

11. The turbine unit according to claim 1, wherein one of the bearing ring (38) or the fastening ring (29) are assembled as the modular unit.

* * * * *